United States Patent [19]

Andersson

[11] Patent Number: 4,528,033

[45] Date of Patent: Jul. 9, 1985

[54] METHOD FOR PRODUCING BLISTER COPPER

[75] Inventor: Bengt T. Andersson, Espoo, Finland

[73] Assignee: Outokumpu Oy, Helsinki, Finland

[21] Appl. No.: 620,442

[22] Filed: Jun. 14, 1984

[30] Foreign Application Priority Data

Jun. 15, 1983 [FI] Finland ..... 832170

[51] Int. Cl.[3] ..... C22B 15/00

[52] U.S. Cl. ..... 75/73; 75/72; 75/74; 75/75

[58] Field of Search ..... 75/73, 72, 74, 75

[56] References Cited

U.S. PATENT DOCUMENTS 4,349,383 9/1982 Chaudhuri ..... 75/73

4,415,356 11/1983 Victorovich ..... 75/73

4,416,690 11/1983 Richards ..... 75/73

*Primary Examiner*—Peter D. Rosenberg

*Attorney, Agent, or Firm*—Brooks, Haidt, Haffner & Delahunty

[57] ABSTRACT

The invention relates to a method for producing blister copper, wherein the matte received from the smelter unit (1) is conducted in molten state into a converter reactor (3) located essentially adjacent to the smelter unit (1), and the molten matte is fed into the converter reactor (3) by means of oxidizing gas so that the molten matte is dispersed into tiny molten particles. In order to create advantageous circumstances for the method, the oxygen potential within the smelter unit (1) is maintained essentially lower than within the converter reactor (3).

4 Claims, 1 Drawing Figure

METHOD FOR PRODUCING BLISTER COPPER

Figure 1:
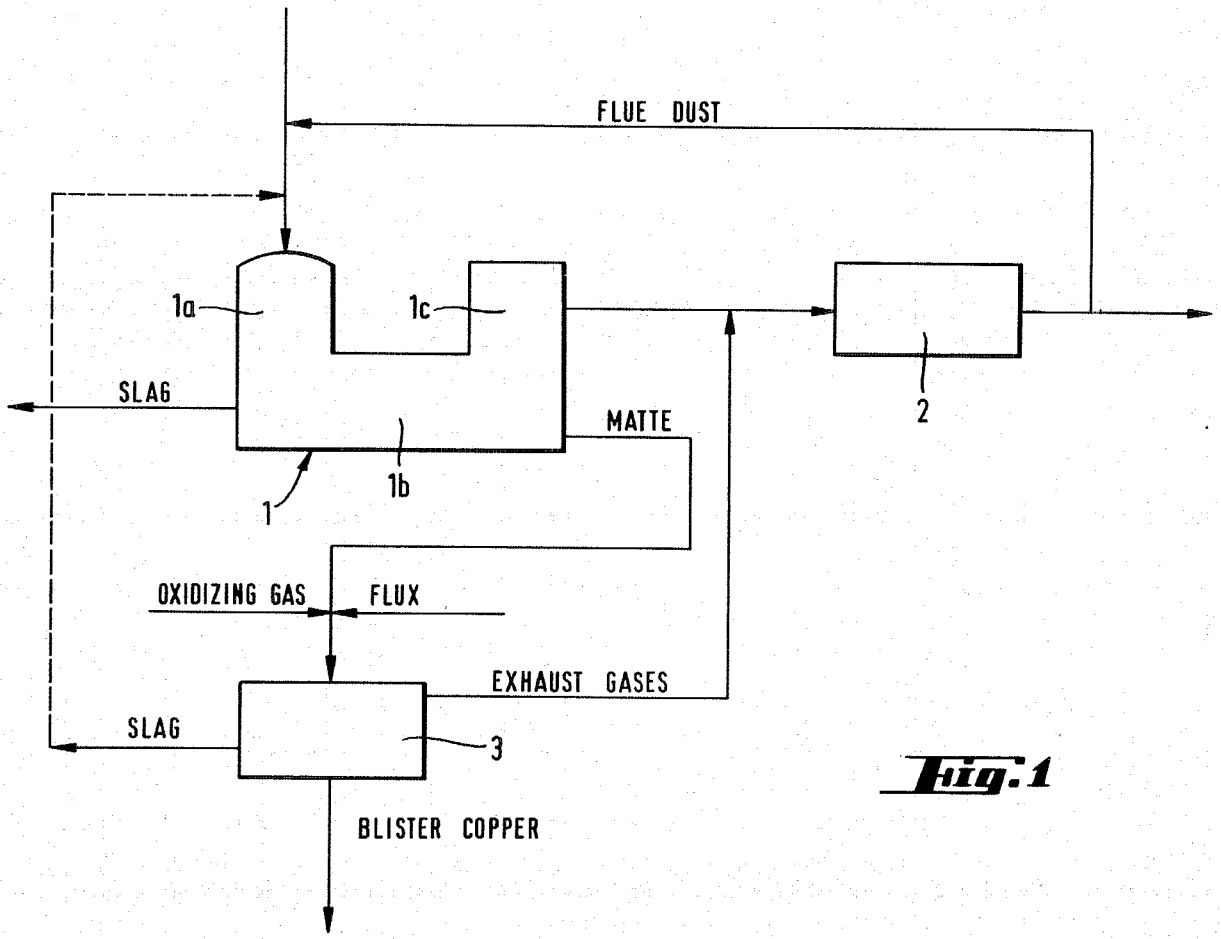

The present invention relates to a method for producing blister copper by feeding the molten matte received from the smelting furnace into a converter reactor which is located essentially adjacent to the smelting furnace, so that the molten matte is dispersed in tiny particles in an oxygen flow or an oxygen-enriched air flow.

The commonest method for producing blister copper comprises a smelter unit and a Pierce-Smith oxygen converter. The molten sulphide matte received from the smelter unit is conveyed in batches into the oxygen converter. In the converter the sulphide matte is oxidized into blister copper in two stages: the slag blowing period and the metal-blowing period. The converter itself has a cylindrical form, and the oxygen blasting is carried out through the tuyeres located at the side of the converter, so that during blowing the converter is turned around its lengthwise axis in order to direct the blow continuously to the sulphide matte phase within the converter.

In the above described Pierce-Smith oxygen converting process, the production of sulphur dioxide gas is discontinuous due to the batchwise nature of the process, which aggravates both the recovery of gas heat in the waste heat boiler and the production of sulphuric acid formed of the created gases. Moreover, when the converter is filled or tapped, sulphur dioxide gases enter the working area, which is problematic with respect to working hygiene and heat recovery.

The production of blister copper as a continuous process has been developed, among others, by Mitsubishi and Noranda. The Mitsubishi process is carried out in three interlinked furnaces: one furnace for concentrate smelting created as a result of oxidizing sulphide iron, one for converting and therebetween an electric furnace for slag cleaning. The molten material flows continuously from the smelting furnace into the electric furnace, the matte from the electric furnace into the converter and the produced blister copper out of the converter. The converter slag which has a high copper content is transferred back into the smelting furnace. However, owing to the low specific capacity of oxygen in the Mitsubishi converter, it is necessary to make the said converter about three times as big as the respective Pierce-Smith converter.

In the Noranda process the production of blister copper is carried out in a continuously operated, converter-like cylindrical furnace. The granulated sulphide concentrate and the flux are transferred into the furnace through the charge end of the said furnace so that the feed mixture covers roughly half of the molten surface within the furnace. The blasting—with air or oxygen-enriched air—is carried out in similar fashion as in an ordinary horizontal converter, i.e. through the tuyeres located at the side. In the Noranda furnace the bottom of the far end of the furnace is raised, so that only slag is let out of the furnace end opposite to the charge end. As soon as blister copper is formed, it is let out through the tap hole located at the middle of the furnace, whereas slag is let out in a continuous flow. However, the received blister copper contains a large amount—roughly 1.5% by weight—of sulphur, wherefore the blister copper must be separately raffinated before electrolysis.

The purpose of the present invention is to eliminate some drawbacks of the prior art and to achieve an improved method for producing blister copper, in which method the molten metal obtained from the copper sulphide concentrate smelter unit is conducted, dispersed in tiny molten particles by means of an oxygen flow or an oxygen-enriched air flow, into a converter reactor located essentially adjacent to the smelter unit.

In order to produce blister copper according to the method of the present invention, the copper sulphide concentrate and the flux are fed, together with oxygen or oxygen-enriched air, into a smelter unit, for instance into the reaction shaft of a suspension smelting furnace. The gases formed within the smelter unit and containing sulphur dioxide are conducted through the settler of the smelter unit and further through the uptake shaft into the waste heat boiler, but the molten slag and the molten matte are tapped through the settler of the smelter unit.

According to the invention, the molten matte received from the smelter unit settler is conducted into the converter reactor located essentially adjacent to the smelter unit, so that the molten matte is dispersed in tiny molten particles by means of oxidizing gas, oxygen or oxygen-enriched air which is fed into the converter reactor. In addition to the tiny molten matte particles, flux is also fed into the converter reactor and possibly also fossil fuel in order to maintain the heat balance.

In the method of the invention, the converter reactor can represent any of the conventional smelting furnace types used in blister copper production; it can be for instance a unit like the smelter unit essentially employed in the method of the invention, or it can be a continuously operated reactor known in the prior art, in which case the drawbacks of a conventional tiltable converter can be eliminated.

In the method of the invention, the exhaust gases are conducted from the converter reactor into the waste heat boiler which is preferably common to the converter and to the smelting unit. The slag and the produced blister copper formed in the reactor are tapped at the bottom of the converter reactor.

In both treatment units of the present invention, i.e. in the smelter unit and in the converter reactor, the process is carried out autogenously. However, in order to create advantageous conditions for oxygen potential in the various phases of the process, particularly as regards materials with a high iron content, it is reasonable to use two separate treatment units. Thus it is possible to achieve a low copper content for the smelter unit slag and to maintain the partial pressure of oxygen in the smelter unit essentially lower than in the converter reactor, where a higher partial pressure of oxygen is necessary for the production of blister copper with a low sulphur content.

When employing the method of the present invention, where the separate treatment units can be located essentially adjacent to each other, the heat energy losses caused by the transportation of molten material from one unit to another are decreased, and the problems with flue gases violating working safety are almost eliminated. For instance a covered launder can advantageously be used between the separate units in order to conduct the molten flow from one unit to another. Moreover, thanks to the close location of the two treatment units, the oxidizing gas can be conducted to both units through the same pipework almost the whole way fro the oxygen plant. Furthermore, it is possible to use the same heat recovery equipment for both treatment units.

In the following the invention is described with reference to the appended drawing which is a schematical illustration of one preferred embodiment of the invention.

According to FIG. 1, in order to realize the method of the invention the suspension smelting furnace 1 serves as the smelter unit. Into the reaction shaft 1*a* of the said suspension smelting furnace 1 is fed the copper sulphide concentrate dispersed in tiny particles, the flux and the oxidizing gas. Through the settler 1*b* is removed the slag formed within the smelter unit, as well as the high-grade copper matte, whereas the exhaust gases are conducted through the uptake shaft 1*c* into gas cleaning 2 and thereafter into practical use. The molten matte received from the smelter unit 1 is conducted, according to the invention, into the converter reactor 3, which is the smelting furnace employed in continuous copper production.

The molten matte is fed into the converter reactor 3 together with the oxidizing gas, so that the molten matte is dispersed in tiny molten particles by means of the oxidizing gas. Moreover, into the reactor 3 is fed flux and, if necessary, fossil fuel in order to maintain the heat balance. The final product received from the reactor 3 is blister copper as well as slag, which is preferably circulated back into the feed-in of the smelter unit 1. The exhaust gases from the reactor 3 are conducted into the gas cleaning equipment 2 which is common for the reactor and the smelter unit, and thereafter into further treatment in order to be used preferably in the production of sulphuric acid.

The advantages of the method of the present invention are also illustrated by means of the following example.

EXAMPLE

According to the invention, the molten matte (75.0% by weight Cu, 3.94% Fe, 20.83% S) received from the smelter unit, i.e. from a suspension smelting furnace, and having the temperature of 1200° C., was fed into a converter reactor together with flux (90% by weight $SiO_2$) and blowing air while the oxygen enrichment degree was 31.5%. Moreover, oil and combustion air was fed into the reactor in order to maintain the heat balance.

The appended Table 1 contains the material balance of the performed trial run in precentages by weight, and Table 2 contains the heat balance of the same trial run. From Table 1 it can be seen that the blister copper produced according to the method of the present invention contained 99% by weight copper and only minor amounts of sulphur and iron. Moreover, over 97% by weight of the total amount of infed copper was formed into blister copper and somewhat over 1.6% by weight was combined with flue dust. Thus only less than 1.4% by weight of the total amount of infed copper was contained in the converter slag.

The slight amount of slag received from the converter reactor can easily be treated together with the smelter unit slag for instance by flotating in order to recover the copper contained in the slag, or the slag can be returned as such into the feed-in of the smelter unit. The flue dust obtained from the converter reactor can also be returned into the material feed-in of the unit after separating the exhaust gases.

The exhaust gas separated from the flue dust is, owing to the high sulphur dioxide content of the gas (23.4% by weight $SO_2$) suitable as such for the production of sulphuric acid, and it can be transferred to a sulphuric acid plant through the same pipework as the exhaust gas received from the smelter unit without any such intermediate gas combination phases as are customary in the normal converting techniques.

TABLE 1

| | Material balance | | | |
|---|---|---|---|---|
| | Cu % by weight | S % by weight | Fe % by weight | $SiO_2$ % by weight |
| In | | | | |
| matte | 75.00 | 20.83 | 3.94 | 0.0 |
| flux | 0.0 | 0.0 | 0.0 | 90.0 |
| Out | | | | |
| blister copper | 99.00 | 0.2 | 0.03 | 0.0 |
| slag | 12.00 | 3.00 | 45.72 | 22.0 |
| flue dust | 58.59 | 16.25 | 3.08 | 1.47 |

TABLE 2

| | Heat balance | | |
|---|---|---|---|
| | °C. | kg/Nm$^3$ | kJ/kg, Nm$^3$ |
| In | | | |
| matte | 1200 | 56315 | 776.1 |
| flux | 25 | 1179 | 0.0 |
| blow air | 60 | 23536 | 45.9 |
| $O_2$ (100%) | 60 | 3592 | 46.2 |
| reaction heat | | | |
| combustion oil | 25 | 150 | 40490 0 |
| combustion air | 25 | 1600 | 0.0 |
| Out | | | |
| blister copper | 1200 | 41405 | 720.2 |
| slag | 1200 | 4744 | 1302.8 |
| flue dust | 1370 | 871 | 1030.7 |
| exhaust gases | 1370 | 34412 | 2229.0 |
| heat losses | | | |

I claim:

1. A method for producing blister copper so that smelting and then converting of the raw material are carried out in separate treatment units comprising conducting molten matte from a smelter unit into a converter reaction, and feeding said molten matte into the converter reactor together with flux and oxidizing gas so that the molten matte is dispersed by the oxidizing gas into tiny molten particles.

2. The method of claim 1, wherein the molten matte from the smelter unit is conducted into a converter reactor which is located essentially adjacent to the smelter unit.

3. The method of claim 1 or 2 wherein the partial pressure of oxygen within the smelter unit is maintained essentially lower than within the converter reactor.

4. The method of claims 1 or 2, wherein the processes both in the smelter unit and in the converter reactor are carried out autogenously.

* * * * *